United States Patent [19]

Arntyr et al.

[11] Patent Number: 4,553,876

[45] Date of Patent: Nov. 19, 1985

[54] METHOD AND APPARATUS FOR LAYING DRAINS IN FROST-SUSCEPTIBLE GROUND, AND DRAINS LAID IN SUCH GROUND

[76] Inventors: Oscar S. Arntyr, Wallingat. 37, 11124 Stockholm; Thord I. Engström, 95018 Bensbyn, both of Sweden

[21] Appl. No.: 543,543

[22] Filed: Oct. 19, 1983

[30] Foreign Application Priority Data

Oct. 19, 1982 [SE] Sweden ..... 8205938

[51] Int. Cl.[4] ..... E02B 11/00

[52] U.S. Cl. ..... 405/50; 52/20; 405/36; 405/133

[58] Field of Search ..... 405/132, 133, 130, 234, 405/149, 217; 52/19, 20, 169.5, 169.7, 169.13, 170

[56] References Cited

U.S. PATENT DOCUMENTS

| | | | |
|---|---|---|---|
| 129,246 | 7/1872 | Ober | 52/20 |
| 248,664 | 10/1881 | Norton | 405/133 X |
| 442,678 | 12/1890 | Hartley | 405/130 X |
| 711,465 | 10/1902 | Bradshaw | 52/20 |
| 1,461,451 | 7/1923 | Powell | 405/234 |
| 1,908,332 | 5/1933 | Eichelman et al. | 52/169.7 |
| 3,621,623 | 11/1971 | Downes | 52/20 |
| 4,253,282 | 3/1981 | Swartz | 52/20 |
| 4,325,572 | 4/1982 | Arntyr et al. | 285/229 |

*Primary Examiner*—Dennis L. Taylor

*Attorney, Agent, or Firm*—Sughrue, Mion, Zinn, Macpeak, and Seas

[57] ABSTRACT

A drain pipe intended for use when laying surface-water drains, manholes and like structures, particularly in frost susceptible ground. The drain pipe has a length such as to enable the pipe to connect a drain cover with a drain-bottom part or a tubular raising member which is connected directly to the drain-bottom part or is connected to the drain-bottom part via one or more additional raising members. The outer form of the drain pipe is slightly conical over at least a part of the length of the pipe, the pipe being arranged to be mounted so that its widest end faces downwards and can be inserted into a socket or collar of the aforementioned drain-bottom part or of a raising member.

The invention also relates to a method of laying a drain while using such a drain pipe, and to a drain laid in accordance with the method.

6 Claims, 7 Drawing Figures

METHOD AND APPARATUS FOR LAYING DRAINS IN FROST-SUSCEPTIBLE GROUND, AND DRAINS LAID IN SUCH GROUND

The present invention relates to a method for laying surface-water drains, manholes and like structures, and particularly to laying such structures in ground which is susceptible to frost, and to drain pipes intended for use when laying said drains and like structures. The invention also relates to a drain which has been laid in accordance with the invention.

Drains which have been laid in frost-susceptible ground are affected by the rise in ground level caused by hardening of the ground as it freezes and resulting in different parts of the drain being lifted apart. When the ground thaws, these mutually separated parts of the drain are unable to resettle correctly, due to their shape and form.

Attempts to reduce the extent to which drains are lifted as a result of frost have previously been made. For example, it has been suggested that the drains should be insulated from the surrounding ground and/or that the ground located close to the drain structure should consist of a substance which is not susceptible to frost. Besides being extremely expensive, these proposed methods also have technical deficiencies, since among other things they can result in the temporary occurrance of troublesome ground profiles in the transition region between the natural ground layer and the substitute material around the drain. In addition, cracks are liable to form at the junction between the different ground materials.

An arrangement which is highly effective in alleviating problems arising as a result of blocked or partially blocked joints, preventing the aforesaid drain parts from settling properly as the ground thaws has been known to the art for a number of years; c.f. in this respect our U.S. Pat. No. 4,325,572.

Since this solution enables the drain parts to accompany movements of the ground as it freezes, the drains can be laid without needing to take extra precautions, such as insulating or isolating the drains from the surrounding ground. The problem which remains to be solved, however, is that of facilitating re-settling of said drain parts when the ground thaws.

The geometric shape of the drain parts has little or no significance when the drain is lifted as the ground freezes. When the ground thaws, however, the shape of said parts is extremely important in determining how the separated drain parts return to their original positions.

The most common type of drain pipe, the so-called socket or faucet pipe, has a geometric form which, under certain circumstances, is highly instrumental in preventing the drain parts in question from returning to their original positions, for example such circumstances as the flow of water, deriving from melting snow, to one side of the drain, the absence of traffic or the presence of but little traffic, and a slow thawing process.

For example, if water flows to one side of a drain only, one side of the drain can be held firm in the frozen ground which has been raised as it froze, while an area of ground close to the opposite side of the drain may have thawed out and become saturated with water, which may result in dirt and the like being carried by the water to a location beneath the outwardly projecting socket at the upper end of the pipe. As the thaw continues and the drain pipe becomes entirely free, it is unable to return to its original position, because of the presence of the dirt etc. carried by said water.

Another series of events common in the case of a slow thaw, and which can also affect straight drain pipes having stepped joints, is as follows: During a first stage of the thaw, the drain pipe can be held raised by the frost in a deeper layer of the ground, while the upper layers of the ground have thawed and are soft. These upper layers are able to settle and to stabilize, and so come into strong frictional contact with the drain pipe. In a later stage, when the thaw has reached the lower levels of the pipe, so as to enable the pipe to return to the level it occupied before being lifted by the frost, the pipe is held firmly by the friction between the stabilized ground layer and the upper end of the pipe.

For various reasons, surface-water drains and waste-water drains are sometimes arranged at a depth which is too shallow with regard to frost risks. In such cases there is a danger of the whole drain being lifted when the ground freezes, i.e. both the upper part and the lower part of the drain together with the associated connecting pipes.

When the lower part of the drain structure is lifted, a cavity is formed therebeneath. This cavity can be completely or partially filled during the winter months or the early part of the thaw. This prevents the drain from returning to its original position, and results in damage to both the drain and to the attachment of the connecting pipes in the lower part of the drain structure. From the aspect of the raising and lowering of the ground due to freezing and thawing condition respectively, the connecting pipes have a favourable geometry and are well able to accompany the movements of the surrounding ground.

An object of the present invention is to provide a method when laying drains of the kind mentioned in the introduction, and to a drain pipe for use therewith, which completely eliminate, or at least substantially reduce, the problems relating to the return of said drain parts to their original position when the ground thaws. Another object of the invention is to provide a drain structure which is suitable for use in frost-susceptible ground.

The method according to the invention is characterized in that there is used a relatively long upper drain pipe, the outer shape of which is slightly conical over at least a part of the length of the pipe; that the pipe is turned with its widest end downwards and is passed down into a socket or collar of a drain-bottom part fitted with a floor member, or of a tubular raising member which is mounted directly to said drain-bottom part or is connected thereto via one or more further raising members. Preferably, a joint guard is arranged over the joint at the lower end of the drain pipe.

Among other things, the use of a conical pipe means that the pipe will be released more readily from frozen ground as the ground thaws, and that the effect of frictional forces between pipe and the surrounding ground layer is greatly reduced.

In order to eliminate problems relating to the return of the drain-bottom part in the case of shallow drains, the lower end of the drain-bottom part is suitably inserted into a socket or collar of a pipe section or the like serving as an anchoring means, a joint guard being arranged over the intermediate joint.

When practising the method according to the invention, it is preferred that the space around the drain is filled with the same kind of substance as that contained in the surrounding ground.

The special characteristic features of a drain pipe for use when laying drains in accordance with the invention, and of a drain laid in accordance with the invention are set forth in the following claims.

The invention will now be described in more detail with reference to the accompanying drawings.

Figure 1:
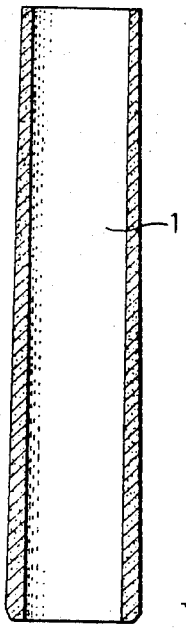
FIG. 1 is a longitudinal sectional view of one embodiment of a drain pipe according to the invention.

FIG. 1 illustrates a drain pipe 1 according to the invention manufactured of reinforced concrete. The pipe 1 has a cylindrical inner surface and an outer surface which tapers linearly and conically from the bottom of the pipe to the top thereof, as seen in the Figure. The conicity preferably lies at about 1–2% and is preferably not greater than 3 to 4%.

The length of the pipe 1 is such as to enable the pipe to connect a drain cover to a drain-bottom part having connecting pipes or a tubular raising member which is connected directly to the drain-bottom part or is connected to said part via one or more further raising members. Thus, the drain pipe 1 preferably extends through the whole of the frost-susceptible ground layer. The pipe can be manufactured in different lengths, or a continuous pipe can be provided with markings or notches which aid cutting of the pipe into lengths suitable for the depth of the pipe system in question, said depth normally being determined by the depth to which that particular ground normally freezes. In this respect, the original length of the pipe may be of the order of 2 meters. The lower, wider end of the pipe is suitably chamfered slightly, to facilitate entry of said end into a socket or collar on the drain-bottom part or the raising member.

The use of a conical drain pipe 1 according to FIG. 1 affords the important advantage that the drain pipe, as a result of its conicity, will be released from the frozen ground, as said ground thaws, at an earlier stage than would be the case with a straight pipe. The conicity thus provides the same release as that sought for within foundry technics. The conicity of the pipe also means that the forces exerted on said pipe by the surrounding ground obtain a more favourable angle of attack relative to the cylindrical surface of the pipe, since there is also obtained a force component in the longitudinal direction of the outer cylindrical surface of the pipe. In addition, vibrations generated in the ground, for example as a result of traffic load, will favourably assist the return of the pipe to its original position, in contrast to the case with conventional drains. In contrast to the majority of known pipes, the drain pipe illustrated in FIG. 1 has no outwardly projecting flange liable to impede the return movement of the pipe as the ground thaws.

The conicity of the pipe 1, however, must not be excessively pronounced, since this would delay lifting of the pipe as the ground freezes, such delay being liable to result in an irregular ground profile. An attempt should be made to ensure that pipe movements coincide as near as possible with ground movements. An excessively pronounced pipe conicity will also result in an unfavourable cavity around the pipe when the pipe resettles to its original position. This cavity is liable to become filled with material carried by water flowing to the drain, said material becoming packed hard around the pipe, and being liable to undermine the surface of the ground, with the subsequent risk of cavity formation.

Figure 2:
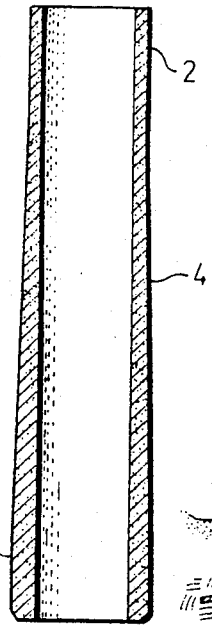
FIG. 2 is a longitudinal sectional view of another embodiment of a drain pipe according to the invention.

FIG. 2 illustrates another embodiment of a drain pipe according to the invention. In this embodiment, the upper and lower parts 2 and 3 of the pipe are circular, while the intermediate pipe portion 4 is conical. The circular parts of the pipe facilitate connection thereof to other drain parts, and also simplify assembly of any joint guard used. A pipe of this configuration also processes properties which are greatly superior to known pipes with regard to the return of said pipes when the surrounding ground thaws. The upper circular part, which in the case of a pipe having a length of 2 meters may have a length of up to about 50 cm, does not greatly affect the tendency of the pipe to return, while a greater portion of the lower circular part, which may have a length of up to about 30 cm, is normally accommodated in a deep socket of an underlying drain part, or is covered by a surrounding joint guard.

The pipe may also be provided with a circular part at solely the upper or lower end thereof. The pipe may also be provided with conical portions of different conicities or conical portions which are mutually separated by circular portions. The conicity of the pipe illustrated in FIG. 2 is preferably within the range of 1–3%, and is suitably not greater than 4 to 5%.

Figure 3:
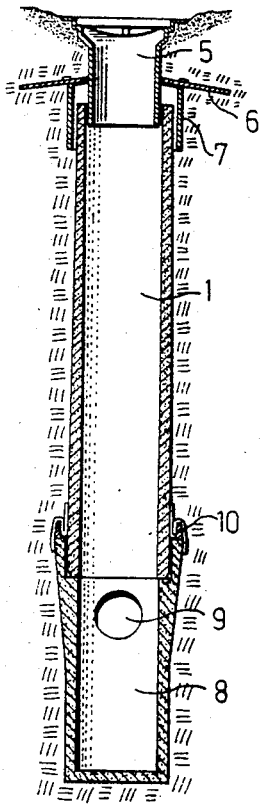
FIGS. 3–5 illustrate different modes of use of a drain pipe illustrated in FIG. 1.

FIG. 3 is a sectional view of one embodiment of a surface water drain according to the invention, the drain being provided with a so-called drain-cover support means according to the U.S. patent application No. 463,448, including a floating top member 5 for supporting a grid or like structure, which is surrounded by a supporting member 6, which is connected to a guide sleeve 7 arranged around the drain pipe 1. The principle under which such a drain cover functions is described in the forementioned patent application, and will not be described in detail here. It should be noted, however, that the supporting member 6 shall not be placed at a greater distance from the surface of the ground than that the zone obtained therebetween is not responsive to frost, i.e. there shall not normally be obtained relative movement between the floating top part 5 and the supporting member 6. Thus, the supporting member 6 can be placed in the support surface on which a road covering is to be laid.

The pipe 1 is of the kind illustrated in FIG. 1, having an outer conicity of 1–2%. The lower end of the pipe 1 is inserted into a deep socket of a drain-bottom part 8 provided with a floor means and having holes 9 for connecting pipes. A joint guard 10 according to our U.S. Pat. No. 4,325,572 mentioned in the introduction is mounted over the joint between the pipe 1 and the drain-bottom part 8. The joint guard 10 enables the pipe 1 to be raised and lowered relative to the drain-bottom part 8, without material liable to prevent such movements penetrating the joint.

The joint guard comprises a cuff which is made of flexible material and the upper portion of which is arranged to lie tightly around the drain pipe 1, and the bottom portion of which cuff is arranged to lie around the drain-bottom part 8. The cuff may be provided with a fold which enables telescopic movement between the drain parts. The function of such a joint guard is explained in more detail in the aforementioned patent application, and will not be described in detail here.

In the FIG. 3 embodiment it is assumed that the drain-bottom part 8 is located at a depth at which the ground will not freeze, so that this part of the drain remains stationary, and so that the whole of the lift experienced as a result of frost takes place as a relative movement between the pipe 1 and said drain-bottom part 8.

Figure 4:
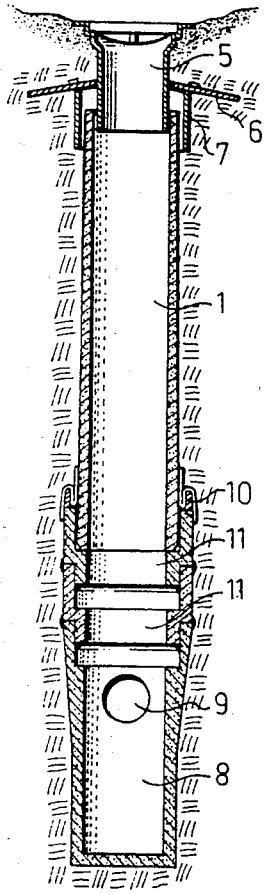

FIG. 4 illustrates a corresponding drain, in which the drain-bottom part 8 is located at such a depth as to necessitate the arrangement of two tubular raising members 11 between the drain-bottom part 8 and the drain pipe 1. When these raising members 11 are located at a depth where no frost occurs, it is only necessary to arrange one joint guard over the joint between the pipe 1 and the upper raising member 11.

Figure 5:
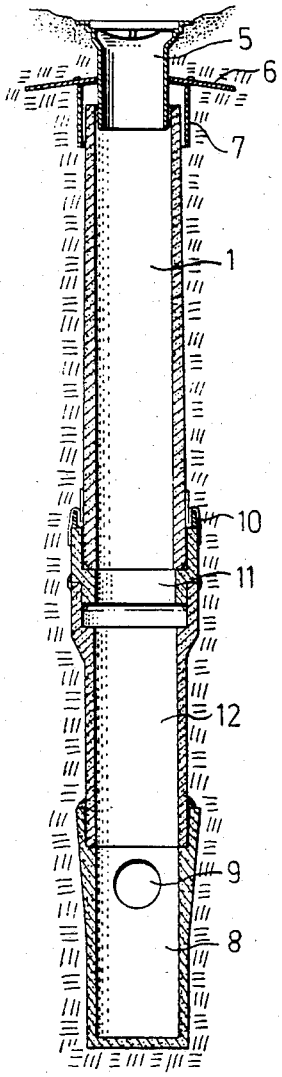

FIG. 5 illustrates a corresponding application. In this case, however, the drain-bottom part 8 is located at such a depth as to necessitate the use of an extended raising member 12 together with a shorter raising member 11 according to FIG. 4. A joint guard is also arranged in this embodiment over the joint located between the drain pipe 1 and the raising member 11.

Figure 6:
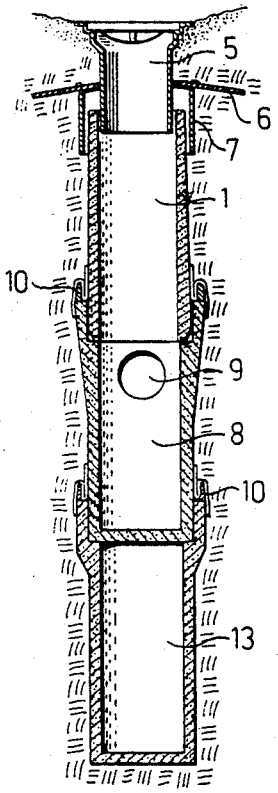
FIG. 6 and FIG. 7 illustrate drains according to the invention placed on a drain section which is effective as an anchoring means.

FIG. 6 illustrates a drain in which, for some reason or other, the drain-bottom part 8 having holes 9 for connecting pipes is not located at a frost-free depth. Thus, in this case the drain-bottom part 8 will also be lifted by the frost, whereupon, if no special measures have been taken, there is a risk of material flowing in beneath the bottom of said drain-bottom part and preventing its return when the ground thaws. In addition to the fact that such lifting of the drain-bottom part 8 will cause the upper part of the drain to project above ground level, therewith causing problems, there is also a risk that the connecting pipes will be damaged at their point of attachment, since these connecting pipes normally accompany the movement of the ground, as a result of their geometry.

This problem is solved in accordance with the present invention, by inserting the drain-bottom part 8 into the collar of a lower tubular section, which in the illustrated embodiment has the form of a blind drain 13, which is located at a frost-free depth and which thus anchors the whole drain. Since movement caused by frost in the ground will also result in movement between the drain-bottom part 8 and the blind drain 13, there is also arranged a joint guard 10 around the joint between said two parts. As with the aforegoing, a corresponding joint guard is arranged around the joint at the lower part of the drain pipe 1. In a drain structure according to FIG. 6, the drain-bottom part 8 will thus also return to its starting position as the ground thaws, therewith eliminating the risk of fracture in the connecting pipes.

Figure 7:
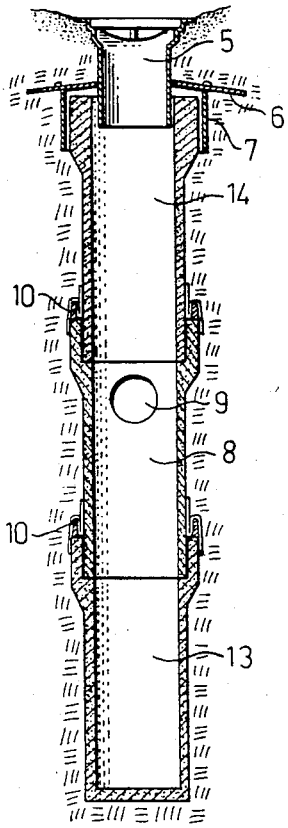

For the sake of completeness, FIG. 7 illustrates a corresponding drain, in which the upper drain pipe 14 is of conventional design, having an outwardly projecting socket at its upper end. The lower blind drain 13 will fulfil the same function here as in the FIG. 6 embodiment.

In the aforegoing, the invention has been described with reference to various embodiments of a drain structure. The invention, however, can be modified in several respects within the scope of the claims. Thus, the drain pipe may be made of a suitable material other than concrete, such as plastics for example. As will be understood, the lengths and other dimensions of the drain pipe may be varied as desired. Other kinds of drains can also be constructed with parts and components according to the invention, while retaining the principle that those parts or components which are not located at a frost-free depth shall be permitted to accompanying lifting of the surrounding ground due to frost, although measures shall be taken to enable and facilitate the return of said parts and components to their original position when the ground thaws.

What is claimed is:

1. A method for laying surface-water drains, manholes and like structures, particularly in ground which is susceptible to frost, wherein said structures are formed of a drain cover at the ground surface, a drain-bottom part and one or more drain pipes extending from the cover to the drain-bottom part, said method comprising the steps of:

initially positioning said drain-bottom part within the ground below the frost line, placing a relatively long, upper drain pipe having an outer form which is slightly conical over the extent of said pipe length within the ground, with the pipe turned with its widest end downwards, inserting the end of said conical pipe into a socket of said drain-bottom part to form a telescopic joint between the bottom of said pipe and said drain-bottom part socket while providing a joint guard over the joint to accept the relative movement between the pipe and the underlying stationary drain-bottom part, and wherein the conicity of the pipe is so small that it does not prevent the pipe from accompanying the raising movement of the surrounding ground due to frost, the purpose of the conicity being to facilitate the return of the pipe when the ground thaws.

2. A method according to claim 1, comprising filling the area around the drain with the same kind of substance as that which is present in the surrounding ground.

3. A drain pipe for a surface-water drain, manhole of like structure, particularly in frost susceptible ground, wherein the drain pipe connects to an overlying cover and to an underlying drain-bottom part stationarily positioned within the ground below the frostline; said drain pipe having an outer form which is slightly conical over at least a part of the length of said pipe; said pipe having an extended length so as to extend the full distance from the drain cover to the drain-bottom part below the frostline, said drain pipe having an outer form which is slightly conical over at least a part of the length of said pipe, said pipe is mountable so that its widest end faces downwardly for insertion within a socket of said drain-bottom part, the improvement wherein the conicity of the pipe is so small that it does not prevent the pipe from accompanying the raising movement of the surrounding ground due to frost, the purpose of the conicity being to facilitate the return of the pipe when the ground thaws, and a joint guard mounted over the joint to accept relative movement between the pipe and the underlying drain-bottom part.

4. A drain pipe according to claim 3, which is uniformly conical over the whole of its length; and the conicity of which does not exceed 3 to 4%, and preferably lies within the range of 1–2%.

5. A drain pipe according to claim 3, wherein the lower and/or the upper end part of said pipe is cylindrical and the remaining part is conical, the conicity not exceeding 4 to 5%, and preferably lying within the range of 1–3%.

6. A drain constituting a surface-water drain, manhole or like structure, said drain comprising an upper drain pipe, a drain-bottom part underlying said upper drain pipe and being connected to said drain pipe, said drain pipe being conical over at least a part of the length of said pipe, and said pipe being turned with its widest end downwards said drain-bottom part including a socket receiving the lower end of said drain pipe, the improvement wherein said drain-bottom part is stationarily positioned within said ground below the frostline, said drain pipe is of extended length so as to extend from the ground surface through the portion of the ground susceptible to frost with its lower end below the frostline, the lower end of said drain-bottom part rests in said socket and a joint guard is arranged over the joint between the lower end of said drain pipe and drain drain-bottom part socket, and wherein the conicity of the pipe is so small that it does not prevent the pipe from accompanying the raising movement of the surrounding ground due to frost, the purpose of the conicity being to facilitate the return of the pipe when the ground thaws.

* * * * *